United States Patent [19]

Yoshikawa et al.

[11] Patent Number: 4,504,136

[45] Date of Patent: Mar. 12, 1985

[54] MAGNETIC DEVELOPING DEVICE WITH OFFSET MAGNETIC POLE

[75] Inventors: Masao Yoshikawa, Naka; Fumitaka Kan, Tokyo; Hiroshi Satomura, Hatogaya, all of Japan

[73] Assignee: Canon Kabushiki Kaisha, Tokyo, Japan

[21] Appl. No.: 484,699

[22] Filed: Apr. 13, 1983

[30] Foreign Application Priority Data

Apr. 24, 1982 [JP] Japan ..... 57-68950

[51] Int. Cl.[3] ..... G03G 15/09

[52] U.S. Cl. ..... 355/3 DD; 118/658

[58] Field of Search ..... 355/3 DD, 14 D; 118/658, 657; 430/122, 903, 102, 103

[56] References Cited

U.S. PATENT DOCUMENTS 4,292,387 9/1981 Kanbe et al. ..... 430/102

4,363,861 12/1982 Nakamara et al. ..... 355/3 DD X

*Primary Examiner*—A. T. Grimley

*Assistant Examiner*—J. Pendegrass

*Attorney, Agent, or Firm*—Fitzpatrick, Cella, Harper & Scinto

[57] ABSTRACT

Disclosed is a developing device in which a movable developer carrying member is disposed in opposed relationship with an image bearing member and one-component magnetic developer is supplied to the developer carrying member and conveyed to a developing area to effect development and which has a developing magnetic pole inside the developer carrying member facing the developing area, the magnetic pole being disposed at a position deviated toward the upstream side with respect to the direction of movement of the developer carrying member from the nearest point between the image bearing member and the developer carrying member.

3 Claims, 6 Drawing Figures

MAGNETIC DEVELOPING DEVICE WITH OFFSET MAGNETIC POLE

BACKGROUND OF THE INVENTION

1. Field of the Invention

This invention relates to a device which uses one-component magnetic developer called magnetic toner to develop an image bearing surface in an image forming apparatus such as an electrophotographic copying apparatus or a facsimile apparatus.

2. Description of the Prior Art

As an electrophotographic developing method using one-component developer, there is known the powder cloud method using toner particles in the form of spray, the contact developing method in which a uniform toner layer formed on a toner supporting member comprising a web or a sheet is brought into contact with an electrostatic image bearing surface to effect development, the jumping developing method in which a toner layer is not brought into direct contact with an electrostatic image bearing surface but toner is caused to selectively jump to the image bearing surface by the electric field of the electrostatic image, or the magnedry method which uses conductive or magnetic toner to form a magnetic brush which in turn is brought into contact with an electrostatic image bearing surface to effect development.

Of the above-described one-component developing methods, in the powder cloud method, the contact developing method and the magnedry method, toner is brought into contact with the electrostatic image bearing surface irrespective of the image portion (the portion to which toner should originally adhere) and the non-image portion (the background area to which toner should not originally adhere) and therefore, the toner more or less adheres to the non-image portion as well and thus, formation of so-called fog could not be avoided. However, in the jumping developing method (disclosed, for example, in U.S. Pat. No. 4,292,387 which matured from U.S. patent application Ser. No. 58,435), the toner layer is not brought into contact with the electrostatic image bearing surface and development is effected with a gap maintained therebetween and therefore, this method is very effective in preventing the formation of fog. This method, however, utilizes the jumping of the toner by the electric field of the electrostatic image to effect development and the visible image obtained by this method suffers from the following disadvantages.

The principal disadvantage peculiar to the jumping developing method is the problem that the image obtained thereby generally lacks in gradation. In the jumping developing method, the toner jumps only when it overcomes the restraining force of the toner supporting member due to the electric field of the electrostatic image. The force which restrains the toner on the toner supporting member is the resultant force of the Van der Waals force between the toner and the toner supporting member, the adhersing force of the adjacent toner particles, the mirror reflection force between the toner and a developer carrying member (hereinafter also referred to as the sleeve) based on the toner being charged, and the magnetic restraining force by a magnet.

Accordingly, only when the potential of the electrostatic image exceeds a predetermined value (hereinafter referred to as the transfer threshold value of the toner) and the electric field resulting therefrom exceeds said restraining force of the toner, jumping of the toner occurs and adherence of the toner to the electrostatic image bearing surface takes place. Although the force which restrains the toner on the toner supporting member differs in value depending on the individual toners or the particle diameter of the toner even if the toner is one produced and compounded by a predetermined prescription, it seems that such force is distributed narrowly about a substantially constant value, and it appears that correspondingly thereto, the threshold value of the surface potential of the electrostatic image at which said jumping of the toner occurs is also distributed narrowly about a predetermined value. Thus, during the jumping of the toner from the supporting member, the presence of the threshold value causes the toner to adhere to the image portion having a surface potential exceeding this threshold value, while little or no toner adheres to the image portion having a surface potential below the threshold value, with a result that there is only obtained an image poor in gradation in which so-called $\gamma$(gamma=the gradient of the characteristic curve of the image density relative to the potential of the electrostatic image) is sharp.

It has been found that if an alternating electric field is applied between the latent image bearing surface and the developer carrying member, said disadvantage is overcome as described, for example, in U.S. Pat. No. 4,292,387, and there can be obtained a fine image of high quality abundant in reproducibility of thin lines and gradation. The effect of the alternating electric field may be explained as follows:

FIGS. 1A and 1B of the accompanying drawings schematically illustrate the developing method described in the aforementioned U.S. Pat. No. 4,292,387, U.S. application Ser. No. 58,435, wherein an alternating electric field is applied between the image bearing member and the developer carrying member. FIG. 1A shows the image portion and FIG. 1B shows the non-image portion. The image bearing member 1 and the developer carrying member 2 are moved in the directions of arrows and pass through developing areas A and B in the meantime. In the developing area A of FIG. 1A, transfer and reverse transfer (i.e. reciprocal movement) of magnetic toner occurs and as the gap between the latent image bearing member 1 and the developer carrying member 2 becomes wider, the electric field therebetween weakens and, in the developing area B, transfer (solid-line arrows) alone occurs and reverse transfer (dotted-line arrows) does not occur. Thus, there is obtained a fine image. On the other hand, in the developing area A′ of the non-image portion of FIG. 1B, reciprocal movement of the toner occurs and in the developing area B′, transfer of the toner does not occur but reverse transfer alone of the toner occurs and therefore, fog is completely eliminated. Designated by $S_1$ in FIG. 1 is a developing magnetic pole disposed at the nearest point between the latent image bearing member 1 and the developer carrying member 2.

Now, where the half value width of the magnetic pole $S_1$ disposed in the developing station is wider than the area in which the toner reciprocates between the latent image surface and the sleeve due to the alternating electric field to develop the latent image (the developing area D=A+B), the magnetic field restraining force strongly acts on the entire developing area and the jumping force of the toner toward the latent image is decreased thereby and thus, the image density is not increased and a good image cannot be obtained.

FIG. 2 of the accompanying drawings shows the relation between the intensity of the magnetic field of the developing magnetic pole $S_1$ and the developing area D. Curve 3 shows the intensity of the magnetic field of the developing magnetic pole $S_1$ on the surface of the sleeve. Line 4 indicates the half value width of the peak value C of the developing magnetic pole. In this case, the developing area D is fully contained in the half value width 4. In the jumping developing method shown in the aforementioned U.S. patent, the magnetic restraining force relative to the toner in the area B of the developing area D wherein development is completed greatly affects the image density. Accordingly, where a magnet in which the half value width 4 is thus wider than the developing area D is used as the developing pole, the magnetic restraining force of the toner is strong in the area B wherein development is completed, and this leads to the disadvantage that the image density becomes lower.

SUMMARY OF THE INVENTION

It is a primary object of the present invention to eliminate the above-noted problems and to provide a developing device capable of obtaining visible images excellent in reproducibility and good gradation as well as high in image density.

It is a further object of the present invention to provide a developing device which enables good developed images free of fog to be obtained even if the original image is colored paper such as newspaper or diazo copy paper.

The gist of the present invention consists in a developing device in which a developing magnetic pole is disposed at a position deviated toward the upstream side with respect to the direction of rotation of the developer carrying member from the nearest point between the image bearing member and the developer carrying member so that the magnetic field becomes weak at the terminal end portion of the developing area.

The above and other objects and features of the present invention will become more fully apparent from the following detailed description taken in conjunction with the accompanying drawings.

DESCRIPTION OF THE PREFERRED EMBODIMENT

An embodiment of the present invention will hereinafter be described in detail with reference to the drawings.

Figure 3:
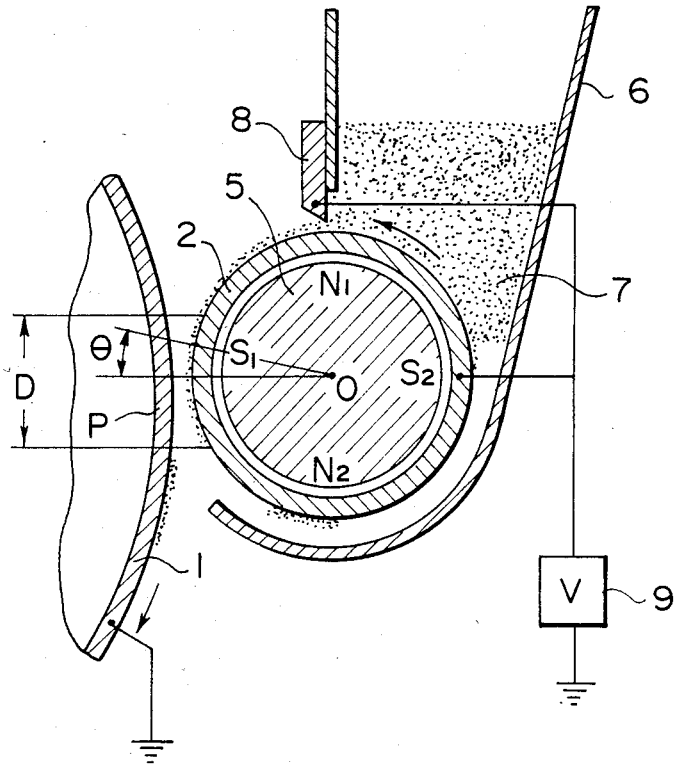
FIG. 3 is a cross-sectional view of the developing device of the present invention.

Referring to FIG. 3 which is a cross-sectional view of a developing device according to an embodiment of the present invention, there is shown a non-magnetic sleeve 2 of aluminum or like material as a developer carrying member disposed with a minute gap relative to a photosensitive medium 1 as an image bearing member, and a magnet roller 5 enclosed in the sleeve 2. Insulative one-component magnetic developer (magnetic toner) 7 is supplied from a non-magnetic container (hopper) 6 to the peripheral surface of the sleeve 2. The magnetic toner 7 has its amount (layer thickness) controlled by a magnetic blade 8 for magnetic cutting formed of a magnetic material or a magnet. To thin the layer thickness of the toner, a magnetic pole ($N_1$ in the drawing) of the magnet roller 5 is disposed in opposed relationship with the magnetic blade 8. That is, the magnetic blade 8 cooperates with the magnetic pole $N_1$ to form a magnetic curtain between the sleeve 2 and the blade 8, which curtain controls the amount of toner passing therebetween to form a toner layer thinner than the gap therebetween.

This thin toner layer formed on the peripheral surface of the sleeve 2 reaches a developing area D in accordance with rotation of the sleeve 2. In the present invention, a developing magnetic pole $S_1$ is disposed in this developing area D. This magnetic pole $S_1$ is fixedly disposed at a position slightly deviated by an angle $\theta$ toward the upstream side with respect to the direction of rotation of the sleeve from a line passing through the center of rotation (not shown) of the photosensitive drum 1 and the center of rotation 0 of the non-magnetic sleeve 2.

Further, an alternating power source 9 generating AC or AC+DC or pulse wave is provided between the sleeve 2 and the photosensitive drum 1 to apply an alternating electric field and, in the developing area D, the toner reciprocally moves in the gap between the surface of the photosensitive drum 1 and the sleeve 2, as previously described, to thereby provide a developed image of good gradation free of fog. Any toner not used for the development but remaining on the peripheral surface of the sleeve 2 is returned into the container 6 with rotation of the sleeve 2.

Figure 1A:
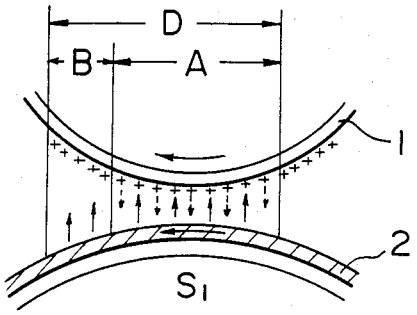
FIG. 1A PRIOR ART
FIGS. 1A and 1B illustrate the jumping developing method.
Figure 1B:
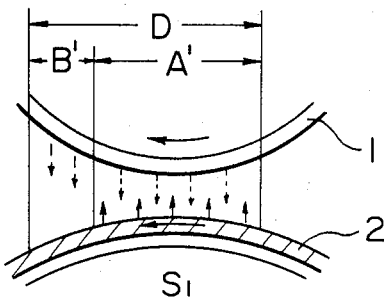
FIG. 1B PRIOR ART
Figure 2:
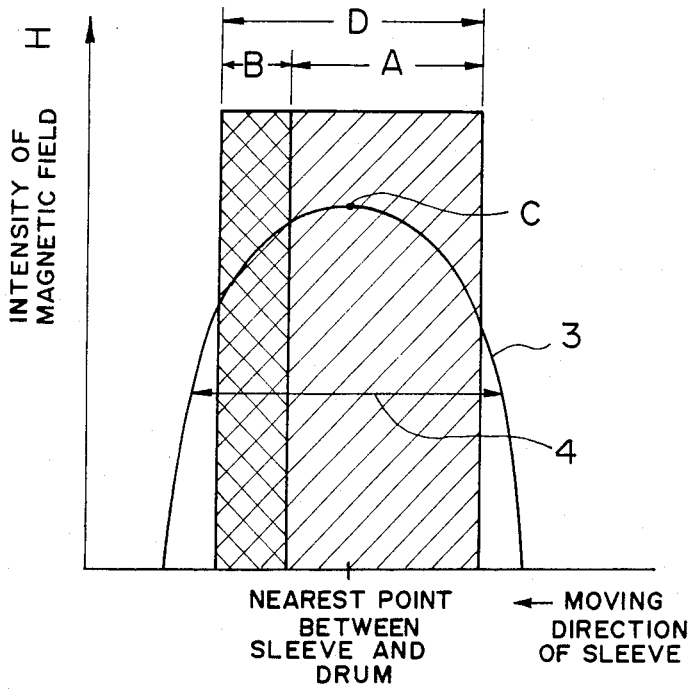
FIG. 2 PRIOR ART
FIG. 2 shows the relation between the intensity of the magnetic field of the conventional developing magnetic pole and the developing area.
Figure 4:
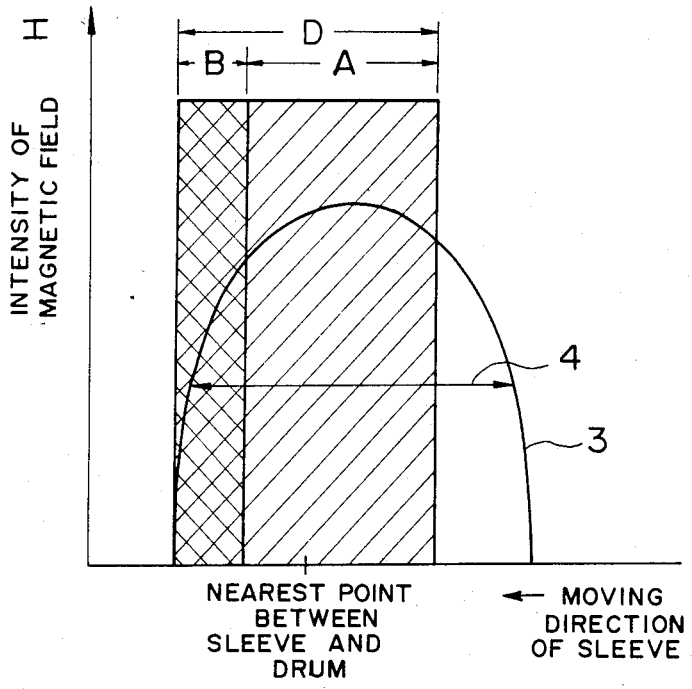
FIG. 4 shows the relation between the intensity of the magnetic field of the developing magnetic pole in the present invention and the developing area.

In the example of the prior art shown in FIG. 2, the half value width 4 of the developing magnetic pole $S_1$ is wider than the developing area D and therefore, the magnetic restraining force in an area B wherein development is completed is great and the image density is low. In the present invention, however, the developing magnetic pole $S_1$ (or, of course, the pole N) is inclined by $\theta$ toward the upstream side of the sleeve from the line passing through the centers of the sleeve and the drum and therefore, the relation between the developing area D and the half value width 4 changes as shown in FIG. 4 and the magnetic restraining force in the development completing area B becomes weaker and thus, it has become possible to increase the image density. In this case, if the magnetic pole is deviated toward the downstream side, the magnetic force in the area B will rather become stronger and this is not preferable.

Figure 5:
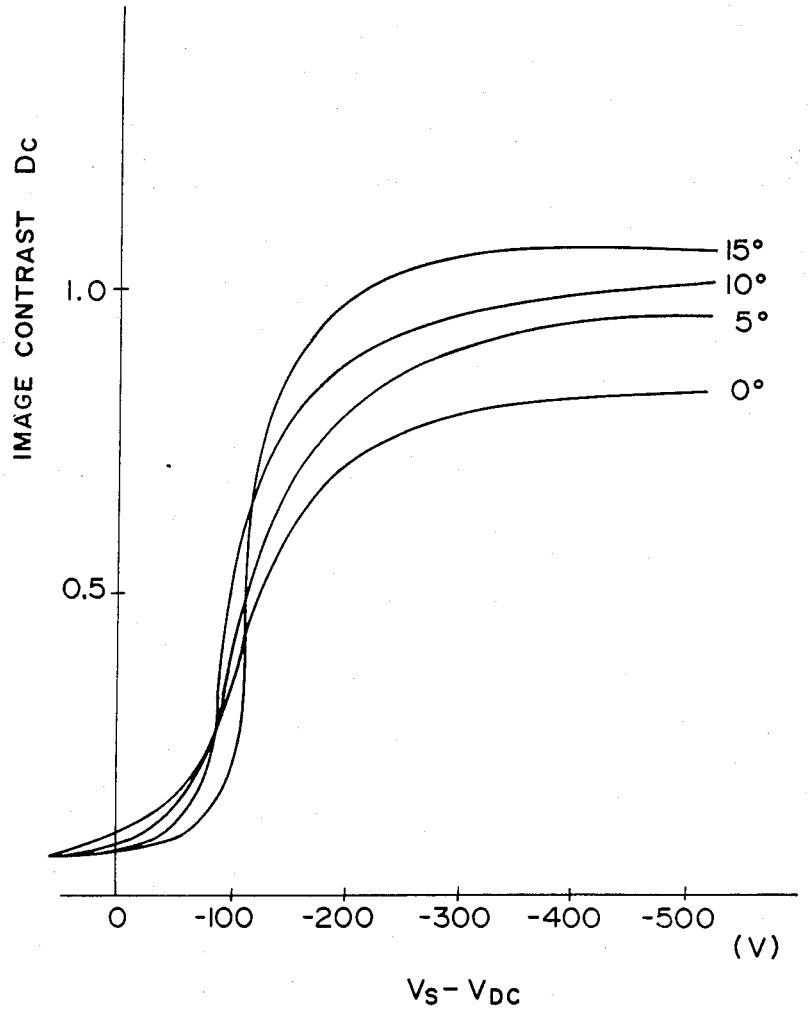
FIG. 5 is a graph showing the V-D curve when the developing magnetic pole is inclined by $\theta$.

FIG. 5 shows a graph in which the V-D curve (the curve of image density D relative to the potential difference between the surface potential $V_S$ of the photosensitive medium 1 and the DC component $V_{DC}$ of the AC+DC alternating current applied to the sleeve 2) is compared between a case where the developing magnetic pole $S_1$ is disposed with an inclination of $\theta=5°$, 10° and 15° toward the upstream side of the sleeve and the case of the prior art ($\theta=0°$) where the magnetic pole is disposed on the line passing through the center of the photosensitive drum 1 and the center of rotation 0 of the sleeve 2, by the use of the device of FIG. 4. From this graph, it will be apparent that an image of high density can be obtained by slightly deviating the developing magnetic pole by $\theta$ in the direction of rotation of the sleeve. According to the experiment, where $\theta$ is smaller than 5°, an image of high density cannot be obtained as compared with the case where $\theta=0°$, and where $\theta$ is greater than 15°, the density is high but $\gamma$ is sharp and the image formed tends to lack more or less in gradation.

Thus, in the present invention, it has been found that $\theta$ should desirably be in the range of 5°–15°, whereby there can be obtained images of high density, free of fog and having good gradation in which $\gamma$ is moderately sharp.

As has been described above in detail, according to the present invention, the developing magnetic pole is disposed at a position deviated toward the upstream side with respect to the direction of rotation of the developer carrying member from the nearest point between the image bearing member and the developer carrying member and therefore, it has become possible to obtain images of high density, free of fog and good gradation.

What we claim is:

1. A developing device for developing a latent image on an image bearing member, comprising:

a developer carrying member disposed in opposed relationship with an image bearing member and movable toward a developing area;

means for supplying one-component magnetic developer to said developer carrying member; and a developing magnetic pole disposed inside said developer carrying member and facing the developing area;

wherein said developing magnetic pole is disposed at a position deviated by an angle $\theta$ in the range of 5°–15° toward the upstream side with respect to the direction of movement of said developer carrying member from the nearest point between the image bearing member and said developer carrying member.

2. A developing device according to claim 1, wherein an alternating voltage is applied between the image bearing member and said developer carrying member.

3. A developing device according to claim 1, further comprising a magnetic blade for forming a thin layer of one-component magnetic developer on said developer carrying member, and a magnetic pole disposed in opposed relationship with said magnetic blade.

* * * * *